US009222291B2

(12) United States Patent
Kakita et al.

(10) Patent No.: US 9,222,291 B2
(45) Date of Patent: Dec. 29, 2015

(54) TOGGLE TYPE FASTENER

(71) Applicants: Yasuyuki Kakita, Chiyoda-ku (JP); Koushi Yamaguchi, Chiyoda-ku (JP)

(72) Inventors: Yasuyuki Kakita, Chiyoda-ku (JP); Koushi Yamaguchi, Chiyoda-ku (JP)

(73) Assignee: SUGATSUNE KOGYO CO., LTD., Chiyoda-ku (JP)

( * ) Notice: Subject to any disclaimer, the term of this patent is extended or adjusted under 35 U.S.C. 154(b) by 203 days.

(21) Appl. No.: 14/013,424

(22) Filed: Aug. 29, 2013

(65) Prior Publication Data

US 2014/0062099 A1 Mar. 6, 2014

(30) Foreign Application Priority Data

Sep. 3, 2012 (JP) ..... 2012-192935

(51) Int. Cl.

| | |
|---|---|
| ***B65D 45/34*** | (2006.01) |
| ***E05C 5/02*** | (2006.01) |
| ***E05C 19/14*** | (2006.01) |
| ***E05B 17/00*** | (2006.01) |
| *E05C 5/00* | (2006.01) |

(52) U.S. Cl.

CPC ..... *E05C 5/02* (2013.01); *E05B 17/0025* (2013.01); *E05C 19/14* (2013.01); *Y10S 292/49* (2013.01); *Y10T 292/089* (2015.04)

(58) Field of Classification Search

CPC ..... E05C 19/063; E05C 19/066; E05C 19/14; Y10S 292/49

USPC ..... 292/66, 256.69

See application file for complete search history.

(56) References Cited

U.S. PATENT DOCUMENTS

| | | | | | |
|---|---|---|---|---|---|
| 2,798,371 | A | * | 7/1957 | Gehrie | 70/73 |
| 2,829,912 | A | * | 4/1958 | Koch | 292/114 |
| 3,847,423 | A | * | 11/1974 | Gley | 292/113 |
| 4,309,044 | A | * | 1/1982 | Schmidt | 280/615 |
| 4,428,608 | A | * | 1/1984 | Cooke et al. | 292/247 |
| 4,830,413 | A | * | 5/1989 | Bisbing | 292/247 |
| 5,127,684 | A | * | 7/1992 | Klotz et al. | 292/113 |
| 6,457,750 | B1 | * | 10/2002 | Sokurenko et al. | 292/113 |
| 7,568,739 | B2 | * | 8/2009 | Lee | 292/80 |

FOREIGN PATENT DOCUMENTS

| | | | |
|---|---|---|---|
| DE | 1096245 | * | 12/1960 |
| DE | 1962629 | * | 6/1971 |
| FR | 663925 | * | 8/1929 |
| JP | 2009-183424 A | | 8/2009 |
| WO | WO 8702553 | * | 5/1987 |

* cited by examiner

*Primary Examiner* — Carlos Lugo
(74) *Attorney, Agent, or Firm* — Masuvalley and Partners

(57) ABSTRACT

A toggle type fastener to releaseably couple a fixed object and a movable object to each other includes a pedestal that is structured to be fixed to the movable object, a toggle lever pivotally coupled to the pedestal, a latching arm pivotally coupled to the toggle lever, a looseness prevention element that prevents movement of the movable object. The looseness prevention element is attached to the latching arm and sized to be hooked to a hooked member that is structured to be fixed to the fixed object.

16 Claims, 15 Drawing Sheets

TOGGLE TYPE FASTENER

This application claims priority under 35 U.S.C. §119 from Japanese patent application serial No. 2012-192935, filed Sep. 3, 2012, entitled "Toggle type fastener," which is incorporated herein by reference in its entirety.

TECHNICAL FIELD

The present invention relates to a toggle type fastener for fixing a closed state of two objects that are a movable object and a fixed object mutually coupled pivotally to each other like a lid and a housing. The present invention especially relates to an improvement of a toggle type fastener provided with a function for preventing looseness between the movable object and the fixed object when the movable object is fastened such that it is fixed to the fixed object.

BACKGROUND OF THE INVENTION

An example of a fastener of this type is disclosed in Patent document 1 (Japanese Unexamined Patent Publication No. 2009-183424). The toggle type fastener 1 disclosed in this Patent document 1 includes:

- a toggle lever (movable object) 20 pivotally supported by a fixed pedestal (fixed substrate) 10 that is fixed and attached to the movable object;
- a latching arm (catch frame) 27 pivotally supported by this toggle lever 20; and
- a hooked member (receiving tool) 30 on which the latching arm 27 is hooked at the time of fastening the movable object to the fixed object, the hooked member being fixed to the fixed object.

When the fastener 1 fastens both of the objects, with the movable object closed with respect to the fixed object, a hooking end of the latching arm 27 on the movable object side is hooked to the hooked member 30 on the fixed object side. Then, the toggle lever 20 and the latching arm 27 are pivotally moved, as if pulling the latching arm 27 towards the hooked member 30 in the hooking direction, until the toggle lever 20 and the latching arm 27 are aligned almost in a straight line, and the toggle lever 20 is folded in the fixed pedestal 10. When the toggle lever 20 is completely folded in the fixed pedestal 10, the latching arm 27 would not be lifted and the fastener fastens the movable object to the fixed object.

Although the fastener fastens a movable object to a fixed object in this manner, in order to prevent the movable object becoming unstable due to looseness of the sealing of the movable object with respect to the fixed object, the hooked member 30 is pivotally supported by a mounting member 31 that is to be fixed to the fixed object. When fastening the fastener 1, the hooked member 30 will seat on the movable object when the latching arm 27 is pulled by the toggle lever 20. Therefore, the hooked member 30 is provided with a function of hooking the latching arm 27 and a function of preventing the loosening of the movable object by pressing the movable object against the fixed object to be in a stable state.

However, with such a structure, the hooked member significantly protrudes out near the opening of the fixed object (housing) when the movable object (lid) is in an opened state. Therefore, it was necessary to perform loading/unloading of items with caution because this hooked member became an obstacle when loading/unloading items into or from the fixed object (housing). There was also a risk of damage to the items in case of accidental contact with the hooked member.

SUMMARY OF THE INVENTION

An object of the present invention is to provide a toggle type fastener in which a looseness prevention means for stably fixing a movable object to a fixed object when the fastener is fastened is provided not on the hooked member side, but rather on the latching arm side so that when the fastener is in an opened state, there is no significant protrusion near the opening of the fixed object, and easy loading/unloading of items through the opening becomes possible.

In accordance with one aspect of the present invention, a toggle type fastener to releaseably couple a fixed object and a movable object to each other includes:

a pedestal that is structured to be fixed to the movable object;

a toggle lever pivotally coupled to the pedestal;

a latching arm pivotally coupled to the toggle lever; and a looseness prevention element that prevents movement of the movable object, the looseness prevention element attached to the latching arm and sized to be hooked to a hooked member that is structured to be fixed to the fixed object.

In accordance with a second aspect of the present invention, a toggle type fastener to releaseably couple a fixed object and a movable object to each other includes:

a pedestal that is structured to be fixed to the movable object;

a toggle lever pivotally coupled to the pedestal;

a latching arm pivotally coupled to the toggle lever;

a looseness prevention element attached to the latching arm, the looseness prevention element preventing movement of the movable object; and a hooked member that is structured to be fixed to the fixed object and hooked to the looseness prevention element.

In accordance with a third aspect of the present invention, a toggle type fastener to releaseably couple a fixed object and a movable object to each other includes:

a pedestal that is structured to be fixed to the movable object;

a toggle lever pivotally coupled to the pedestal;

a latching arm pivotally coupled to the toggle lever;

a hooked member that is structured to be fixed to the fixed object and hooked to the latching arm when the movable object and the fixed object are releaseably coupled; and a looseness prevention element that prevents movement of the movable object so that the movable object is securely fixed when the movable object and the fixed object are releaseably coupled, wherein the looseness prevention element includes a pressing member attached to the latching arm, and the pressing member contacts the movable object when the movable object and the fixed object are releaseably coupled.

According to the present invention, the looseness prevention means is provided not in the hooked member but in the latching arm unlike the prior art. Therefore, when the movable object is opened with the fastener open, the looseness prevention means does not project at the opening of the fixed object, and the hooked member can have a low and simple shape in which the latching arm can hook on to the hooked member. Accordingly, loading/unloading of items through the opening of the fixed object can be performed easily without obstruction, and there is also no chance of items getting damaged.

BRIEF DESCRIPTION OF THE DRAWINGS

FIG. 1A is a perspective view of the opened state. FIG. 1B is a perspective view of the housing with the movable object (door) closed and fastened.

DETAILED DESCRIPTION OF INVENTION

Figure 1A:
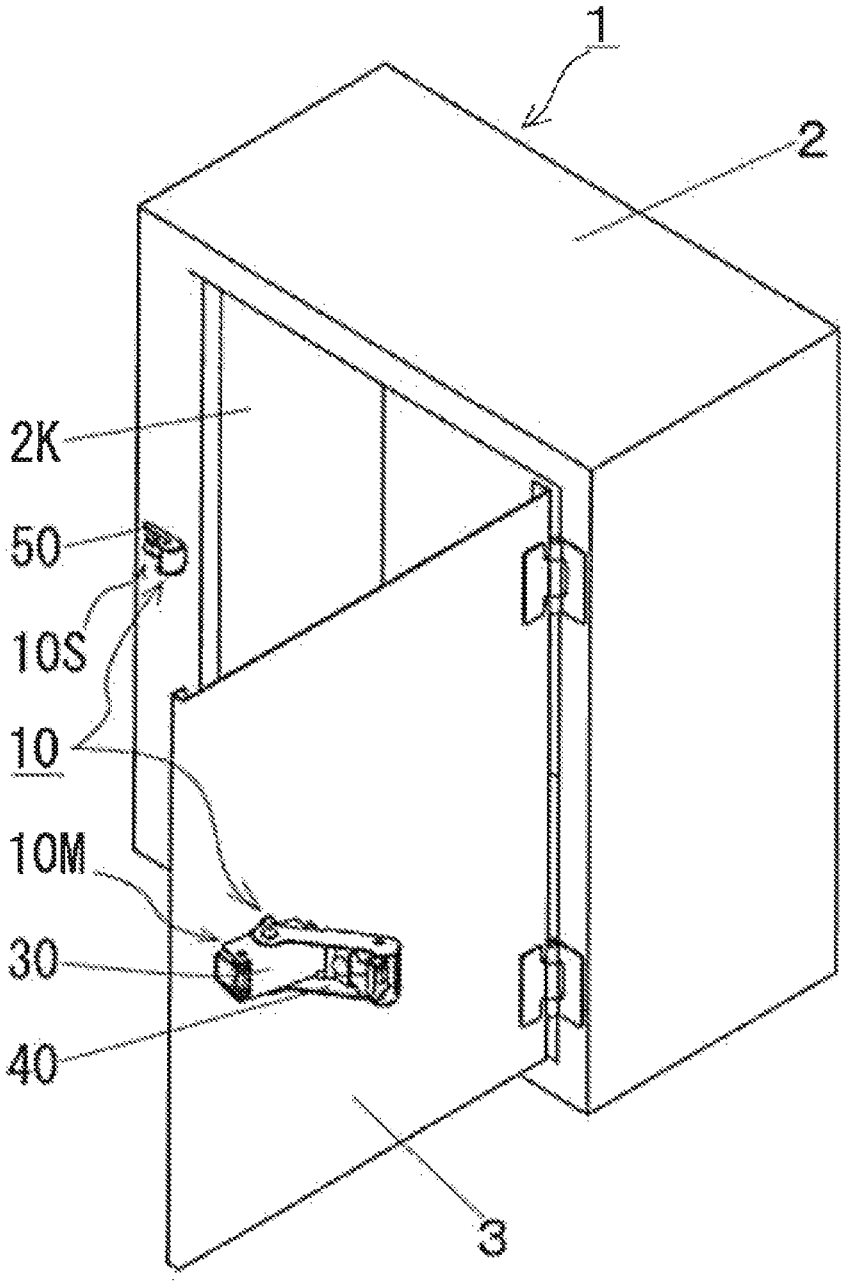
FIG. 1A and FIG. 1B show a housing with a toggle type fastener of the present invention attached.
Figure 1B:
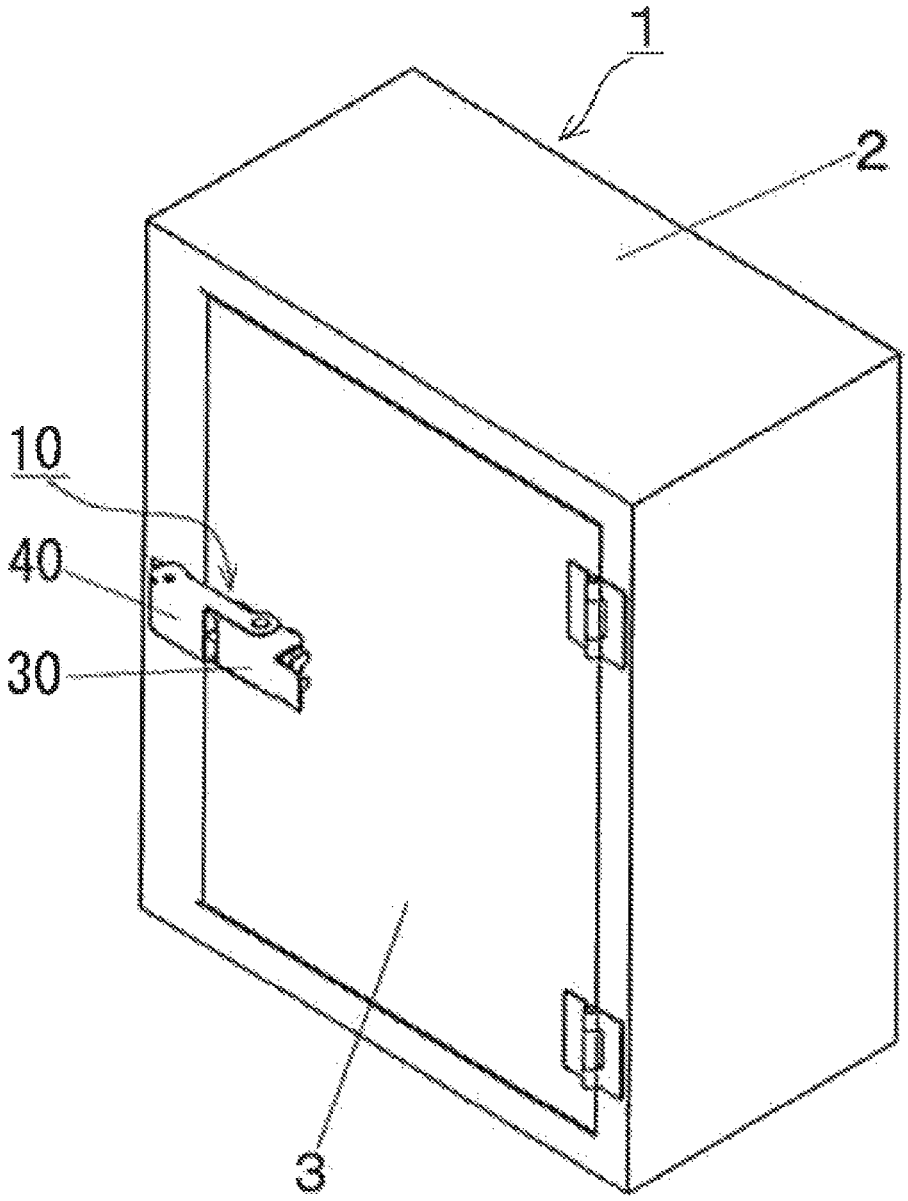
Figure 2:
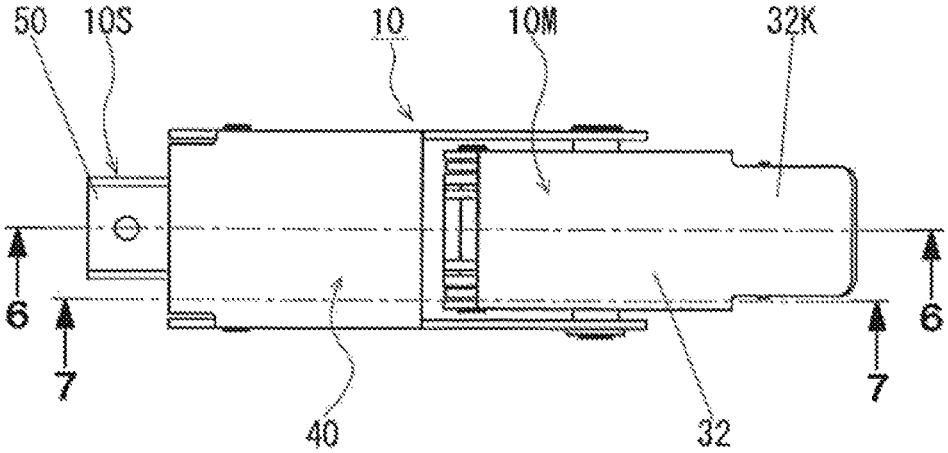
FIG. 2 is a top view of a toggle type fastener according to an embodiment of the present invention.
Figure 3:
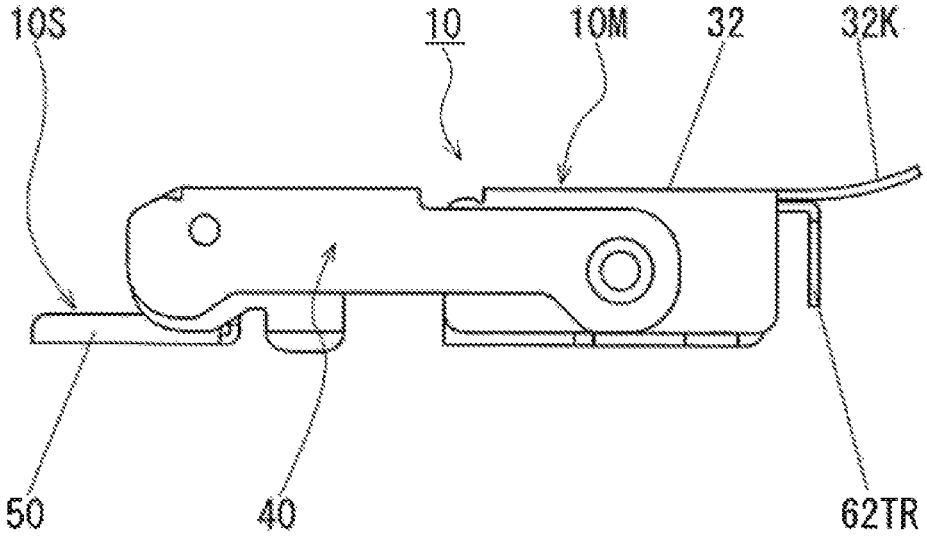
FIG. 3 is a side view of the fastener of FIG. 2.
Figure 4:
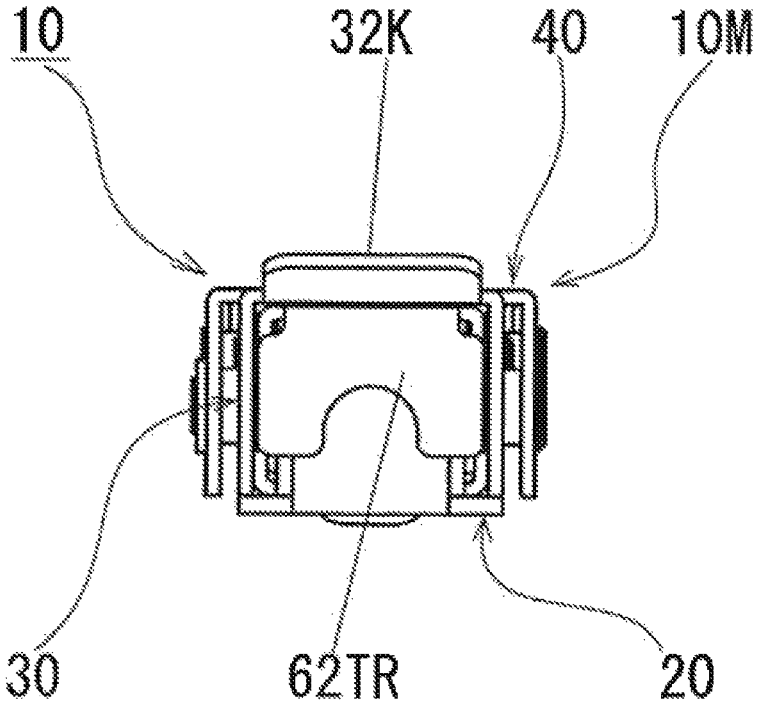
FIG. 4 is a front view of the fastener of FIG. 2.
Figure 5:
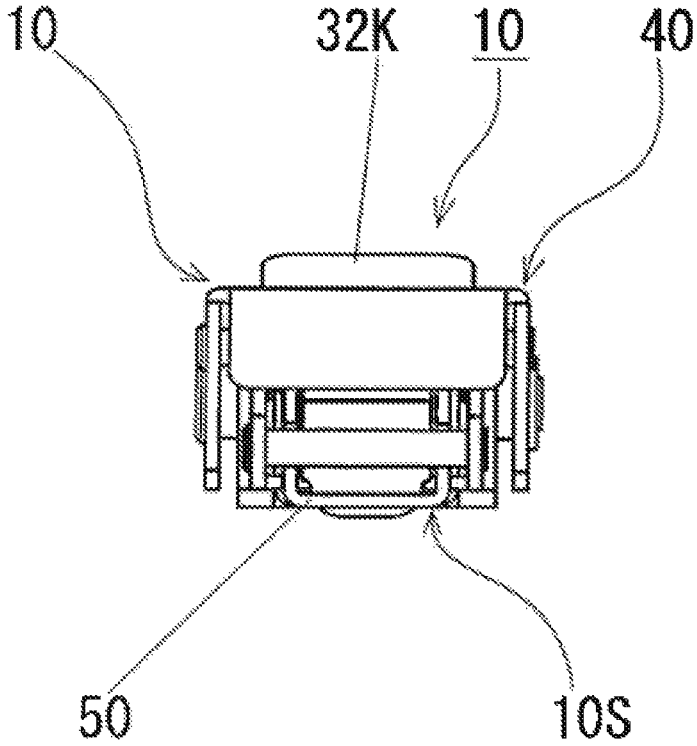
FIG. 5 is a rear view of the fastener of FIG. 2.
Figure 6:
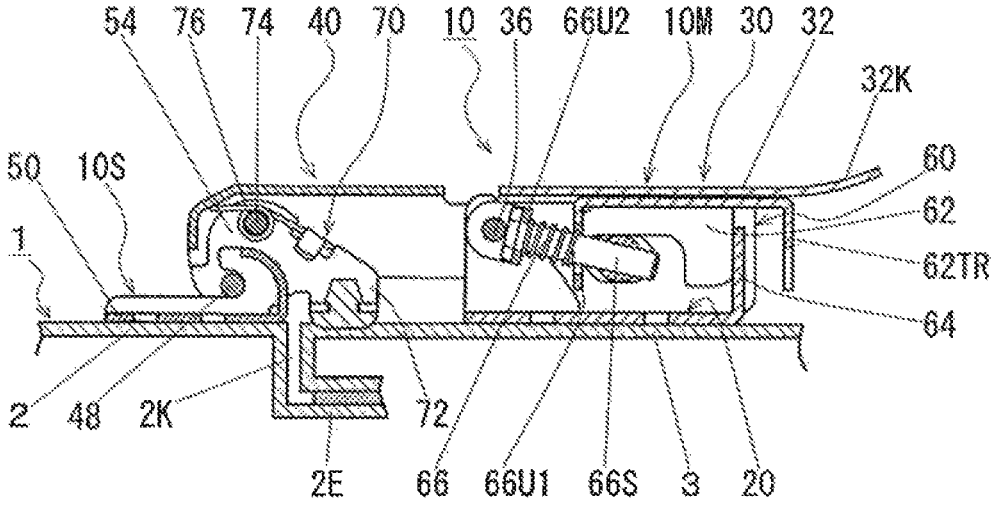
FIG. 6 is a cross-sectional view along line 6-6 of the fastener of FIG. 2.
Figure 8:
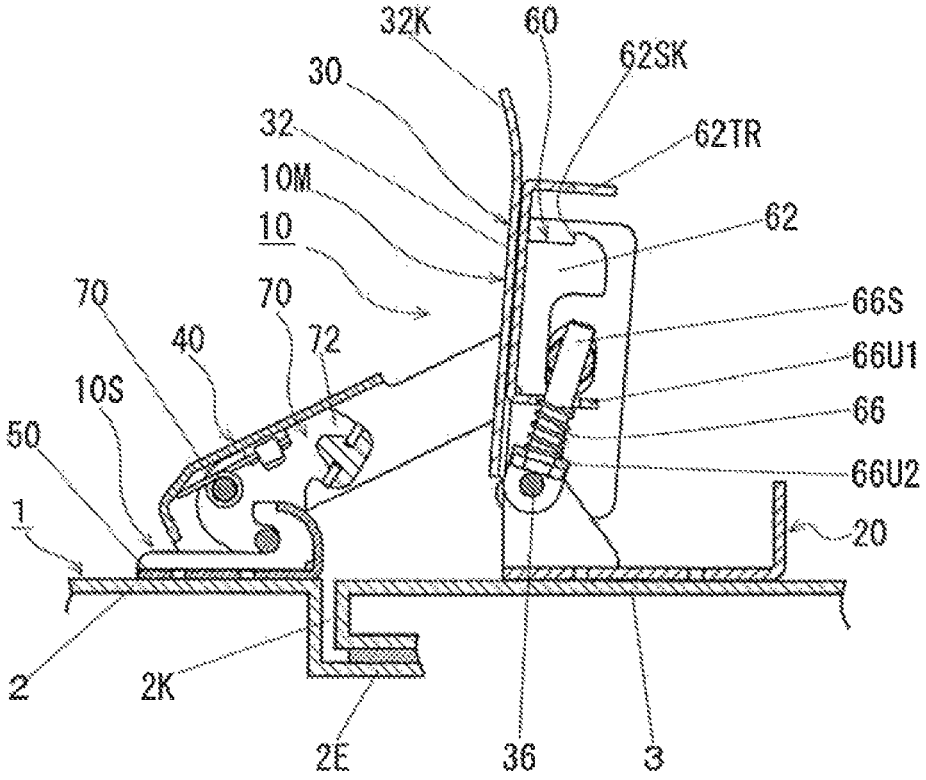
FIG. 8 shows the same cross-section as in FIG. 6, but is a cross-sectional view showing the fastener during the fastening operation.

The use condition of a toggle type fastener 10 according to a preferred embodiment of the present invention is shown in FIG. 1A and FIG. 1B. This toggle type fastener 10 is employed for fastening a housing 1 to a closed state, the housing 1 being made of a housing body 2 that is a fixed object, and a door 3 that is a movable object for closing an opening 2K of this housing body 2 with a hinge. The door 3, as shown in FIG. 1A, FIG. 6 and FIG. 8, is configured to close by engaging with a receiving edge 2E formed as a recess inside the circumferential surface of the opening 2K of the housing body 2.

The toggle type fastener 10 of the present invention includes:

a movable object side section 10M including: a fixed pedestal 20 that is to be fixed and attached to the outer surface of the door 3, which is a movable object; a toggle lever 30 pivotally supported by the fixed pedestal 20; and a latching arm 40 that is pivotally supported by the toggle lever 30 such that it can be displaced in a longitudinal direction of the toggle lever 30; and a fixed object side section 10S including a hooked member 50 that is to be fixed near the opening 2K of the housing body 2 that is the fixed object, and that is to be hooked to the hooking end of the latching arm 40.

The fastener 10 further includes:

- a locking means 60 for locking the toggle lever 30 to the fixed pedestal 20 when the door 3 is closed and fastened to the housing body 2; and
- a looseness prevention means 70 for preventing looseness (rattling) of the door 3 by stably fixing the door 3 by pressing the door 3 against the receiving edge 2E of the housing body 2 when the door 3 and the housing body 2 are fastened to each other.

As shown in FIG. 8, and FIG. 9 through FIG. 11, the fixed pedestal 20 includes:

- a substrate 22 that is fixed on the exterior surface of the door 3 with a locking screw 26;
- one set of vertical pieces 24 rising from both sides of the front end of the substrate 22; and
- a locking piece 64 rising from the rear end of the substrate 22.

Figure 7:
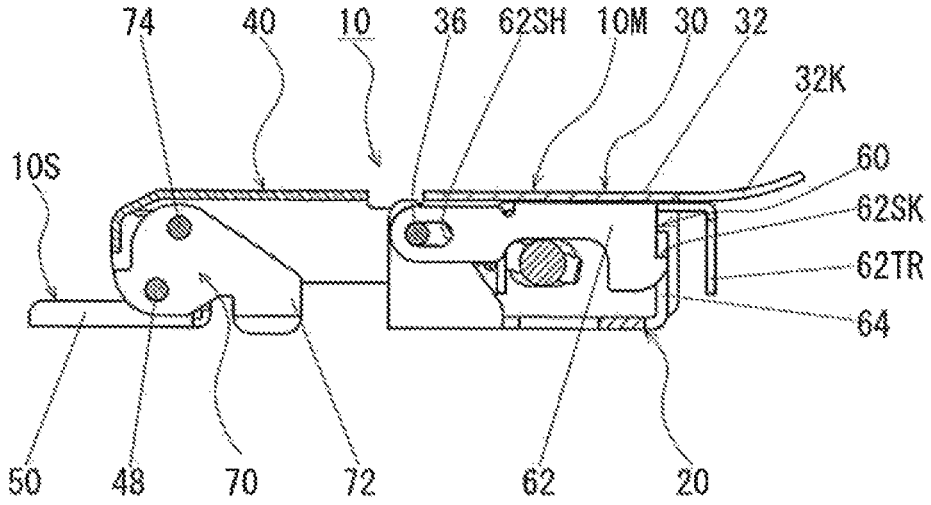
FIG. 7 is a cross-sectional view along line 7-7 of the fastener of FIG. 2.

The locking piece 64 constitutes a part of a locking means 60, which is described later (see FIG. 7).

Figure 9:
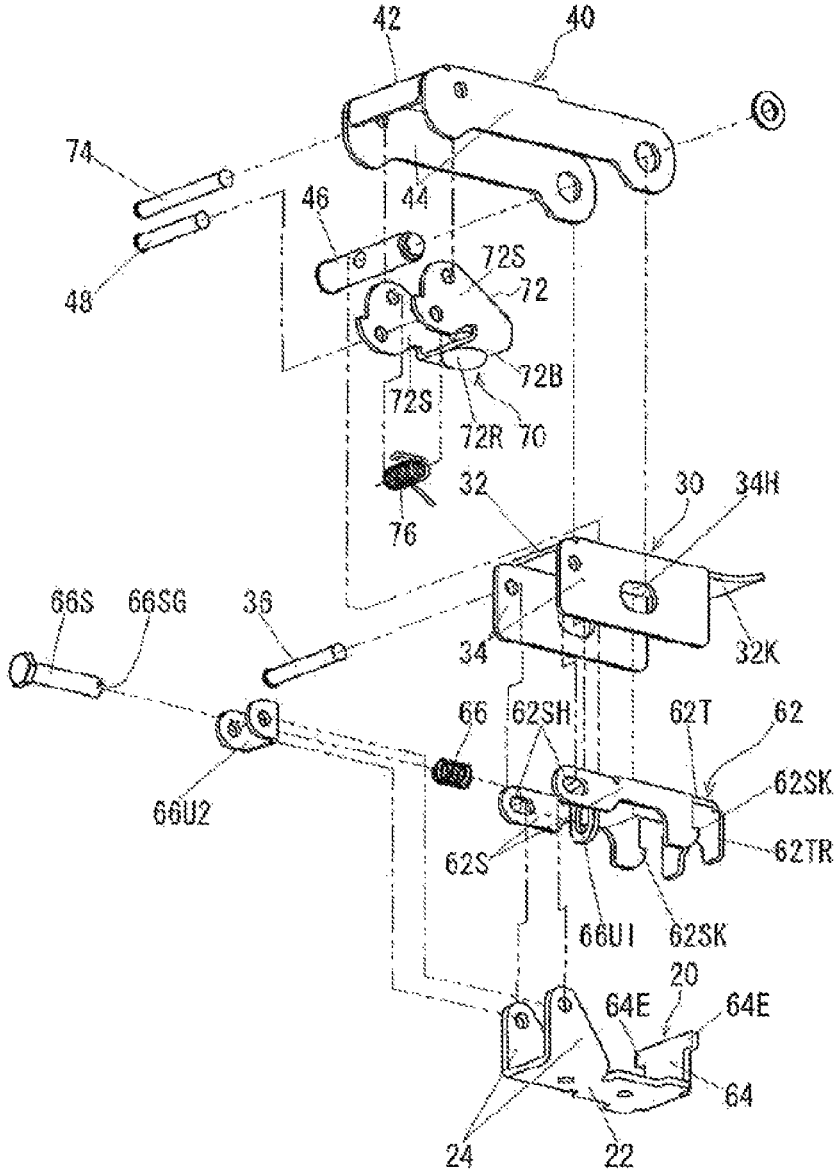
FIG. 9 is an exploded perspective view of the fastener of FIG. 2 without the hooked member.

As shown in FIG. 6, FIG. 8 and FIG. 9, especially in FIG. 9, the toggle lever 30 includes a top plate 32 and a pair of side pieces 34 that vertically suspends from both sides of the top plate 32 excluding its rear side. The toggle lever 30 is pivotally attached to the fixed pedestal 20 by having the pair of side pieces 34 pivotally supported to a pair of vertical pieces 24 of the fixed pedestal 20 by a pivot pin 36. The top plate section curving upwards extending from the pair of side pieces 34 of the toggle lever 30 constitutes a handle 32K, which is used for manually pivoting the toggle lever 30 in the tightening direction.

The toggle lever 30 includes a latch member 62 disposed therein, and this latch member 62 constitutes a locking means 60 (described later) together with the locking piece 64 of the fixed pedestal 20.

As shown in FIG. 2, FIG. 3, and FIG. 6 through FIG. 9, the latching arm 40 is comprised of a pair of side pieces 44 interconnected by an upper connecting piece 42, and the rear end of the pair of side pieces 44 of this latching arm 40 is pivotally supported to a pair of side pieces 34 of the toggle lever 30 by a pin 46. As shown in FIG. 6 through FIG. 9, a support hole 34H of the pair of side pieces 34 of the toggle lever 30 supporting the pin 46 is longer in the longitudinal direction of the toggle lever 30. Accordingly, the pivoted section of the latching arm 40 can be displaced in the longitudinal direction of the toggle lever 30. The detail of this mechanism is described later.

A tip of the latching arm 40 is provided with a hooking part in the form of a hook pin 48 that is to be hooked to a hooked member 50 of the fixed object side section 10S and that is attached via a looseness prevention means 70, which is described later.

While the hooked member 50 is attached in the vicinity of the opening 2K of the housing body 2, which is the fixed object, as shown in FIG. 6, FIG. 8 and FIG. 11, this hooked member 50 includes a hook part 54 to which the hook pin 48 of the latching arm 40 is to be hooked at the end part of the opening 2K side of the receiving seat 52 fixed to the housing body 2 by a screw 56.

The locking means 60, as already described, is comprised of a latch member 62 disposed inside the toggle lever 30, and a locking piece 64 provided in the fixed pedestal 20. The latch member 62, as shown in FIG. 9, is comprised of a pair of side pieces 62S connected by a top plate 62T. As shown in FIG. 7 and FIG. 9, the latch member 62 is pivotally supported by the toggle lever 30 with the pivot pin 36 (a pin that pivotally supports the toggle lever 30 to the fixed pedestal) penetrating through long holes 62SH formed in the side pieces 62S, and includes a hook part 62SK at a tip of the pair of side pieces 62S. The locking piece 64 also includes a hook part 64E that engages with the hook part 62SK of the pair of side pieces 62S of the latch member 62. When the hook part 62SK of the latch member 62 is engaged with the hook part 64E of the locking piece 64, the latch member 62 and the toggle lever 30 integrated therewith are locked to the fixed pedestal 20.

The latch member 62 has a spring 66 that biases the latch member 62 toward the locking piece 64 so as to be able to retract for only the surplus clearance between the long hole 62SH and the pivot pin 36. This spring 66 is disposed between a first spring rest 66U1 that vertically suspends between the side pieces 62S from the top plate 62T of the latch member 62, and a second spring rest 66U2 attached between the pair of side pieces 62S of the latch member 62 by the pivot pin 36 penetrating them. A spring support screw 66S is screwed to the second spring rest 66U2 and penetrates the spring 66.

Therefore, the spring 66 is held between the pair of side pieces 62S by the spring support screw 66S.

Accordingly, the latch member 62 is normally biased towards the locking piece 64 by the spring 66, and an engagement between the latch member 62 and the locking piece 64 is maintained. However, for retracting the latch member 62 from the locking piece 64 while resisting the spring 66 in order to release this lock, the latch member 62 is provided with a lock release piece 62TR extending from the top plate 62T so as to protrude larger than the locking piece 64.

The spring support screw 66S is screwed into the pin 46 that penetrates the long holes 34H of the toggle lever 30, and the tip of the spring support screw 66*s* protrudes from the pin 46. A driver engaging groove 66SG is provided at the protruded tip of the spring support screw 66S. By engaging a driver to the driver engaging groove 66SG of this spring support screw 66S and rotating the spring support screw 66S to left or right, it is possible to displace the position of the pin 46. This is suitable, for example, for making an adjustment of a positional relationship if a hooking positional relationship between the latching arm 40 and the hooked member 50 is improper after attaching the movable object side section 10M and the fixed object side section 10S to the door 3 and the housing body 2 respectively.

The looseness prevention means 70 is comprised of a pressing member 72 attached near the latching end of the latching arm 40. This pressing member 72, as shown in FIG. 6 through FIG. 9, has a pair of side pieces 72S rising from a bottom plate 72B. This pair of side pieces 72S is pivoted and attached swingably to the pair of side pieces 44 of the latching arm 40 by the pivot pin 74. The hook pin 48, which is intended for hooking the latching arm 40 to the hooked member 50, is fixed between the both side pieces 72S of the pressing member 72 at a position lower than the pivot pin 74 and at a position opposite to the seating surface with respect to the pressing member 72.

The pressing member 72 has an elastic engaging piece 72R that presses the door 3, which is a movable object, against the receiving edge 2E of the housing body 2, which is a fixed object, on the seating surface.

A spring 76 is wound around the pivot pin 74, and the respective ends of the spring 76 engage with the seating surface side of the pressing member 72 and the top plate 42 of the latching arm 40 respectively. Therefore, this spring 76 is angularly biased around the pivot pin 74 so as to bias the pressing member 72 towards the inner surface of the top plate 42 of the latching arm 40 in a normal state. Accordingly, the pressing member 72 is biased towards a position away from the seating surface by the spring 76.

When the hook pin 48 of the pressing member 72 is hooked to the hooked member 50 (see FIG. 8), and the handle 32K of the toggle lever 30 is pushed down and fastened in order to fasten the fastener 10, the hook pin 48 is pushed towards the opposite side relative to the seating side. Therefore, the pressing member 72 pivots around the pivot pin 74 in a direction away from the hooked member 50 together with the latching arm 40 and the elastic engaging piece 72R is seated on the outer surface of the door 3, and the door 3 is pressed against the receiving edge 2E of the housing body 2.

Figure 10:
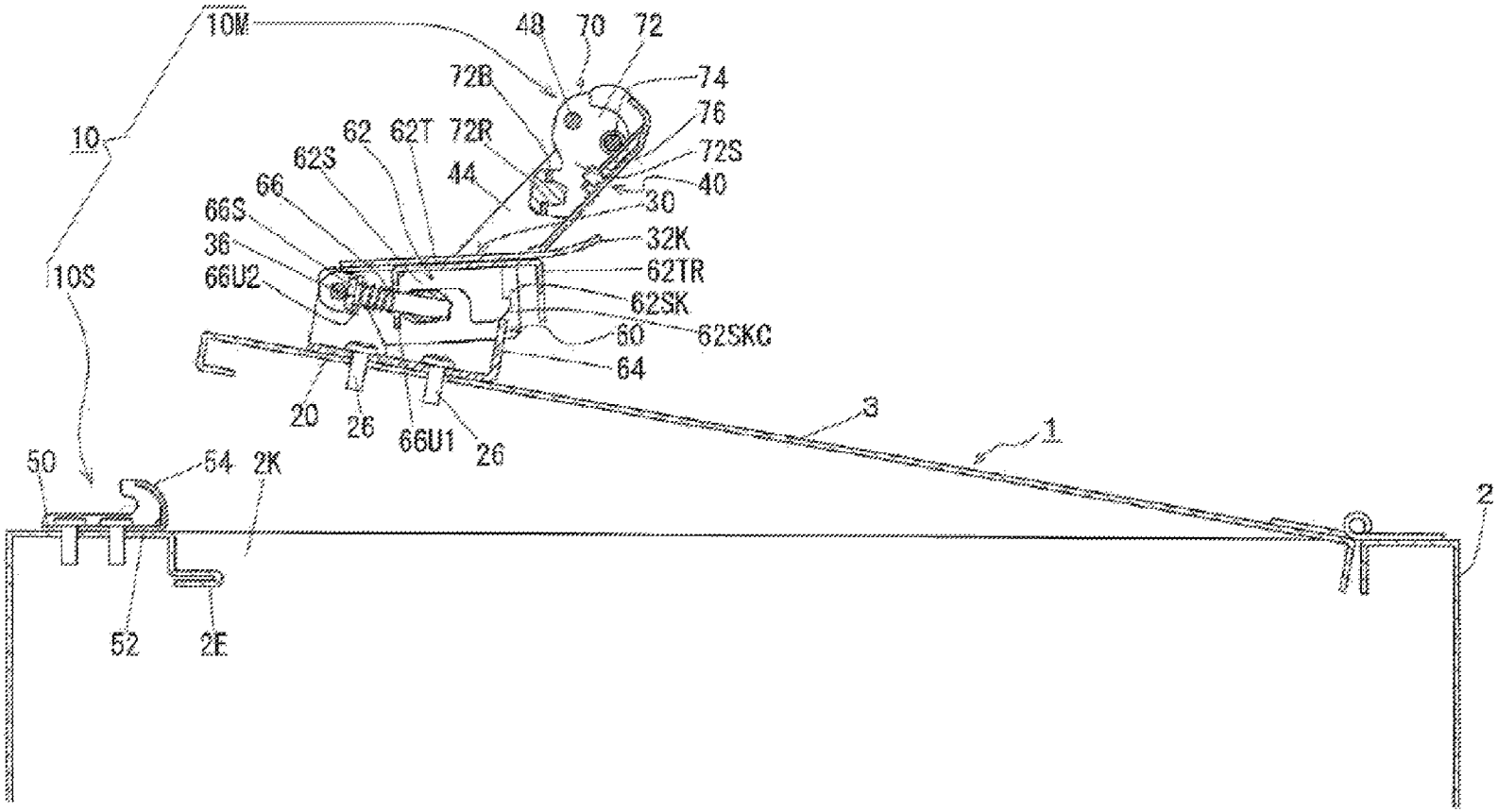
FIG. 10 is a horizontal cross-sectional view showing a state that is in the middle of closing the door from the state in FIG. 1A.

The operation steps of the toggle type fastener of the present invention are shown in FIG. 10 and FIG. 11. As shown in FIG. 1A, after fully opening the door 3 and loading/unloading items through the opening 2K of the housing body 2, the state just before the door 3 is closed from the state shown in FIG. 1A is illustrated in FIG. 10, and the state where the opening 2K of the housing body 2 is fully closed with the door 3 is shown in FIG. 11A.

Figure 11A:
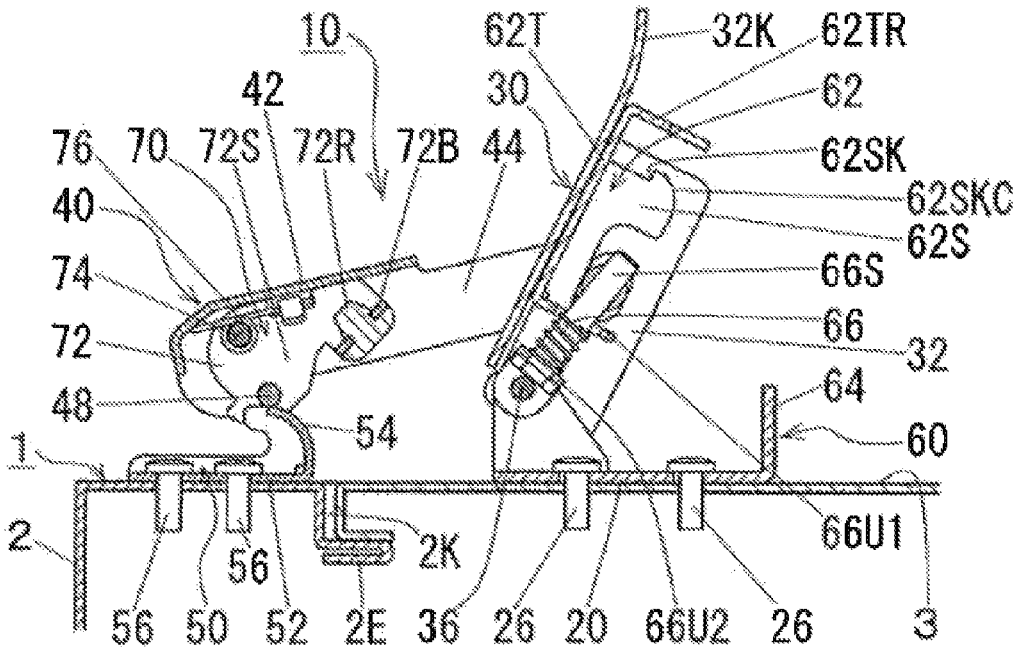
FIG. 11A through FIG. 11D are horizontal cross-sectional views sequentially depicting the steps of closing the door and fastening the fastener from the state in FIG. 10.
Figure 11B:
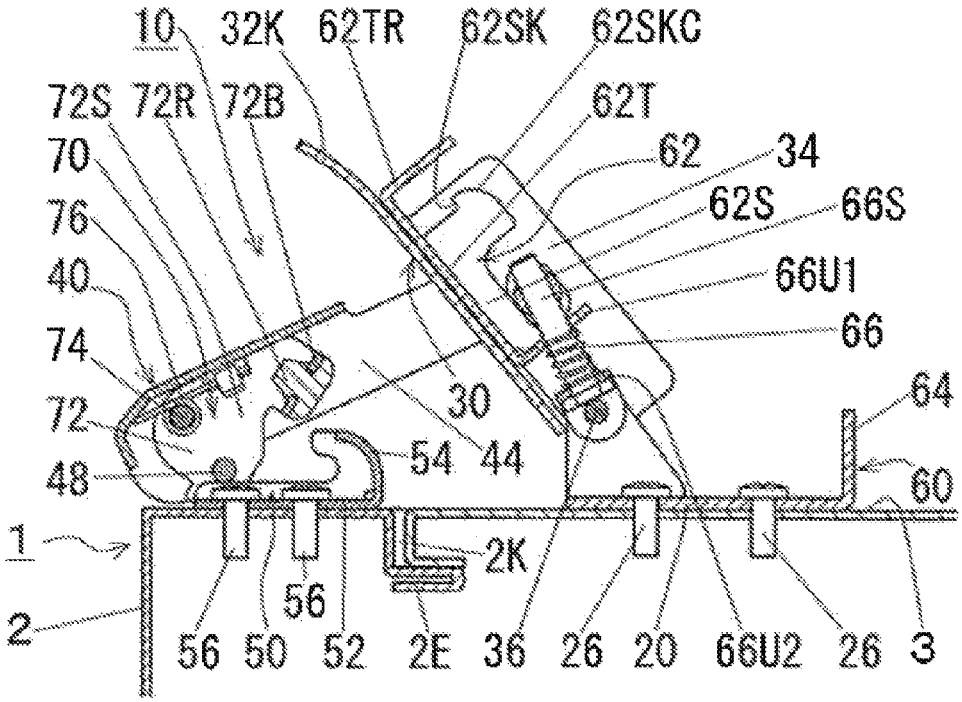
Figure 11C:
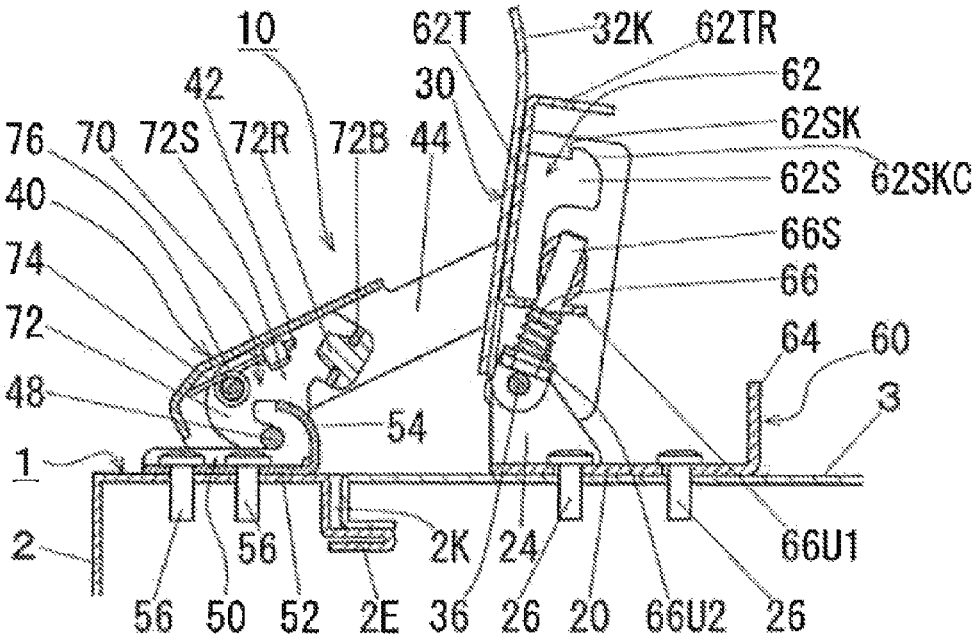
Figure 11D:
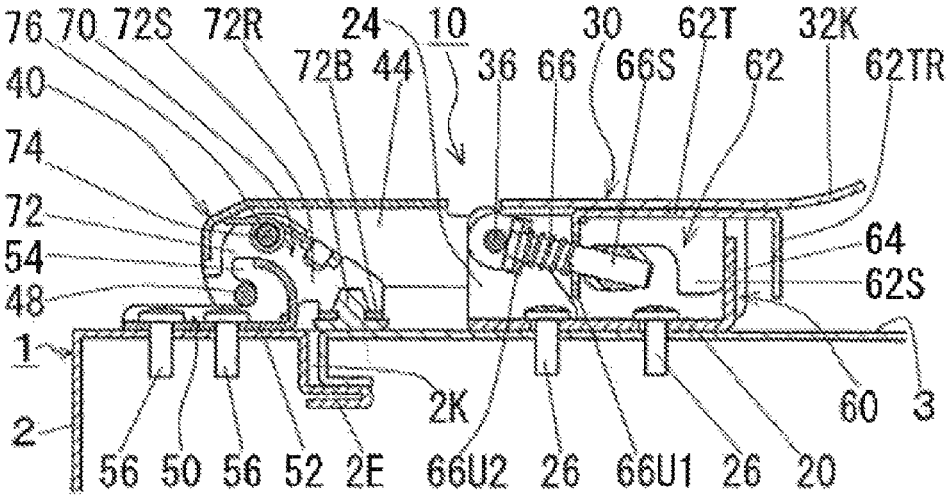

From the state of FIG. 11A, by operating the toggle type fastener 10 of the present invention in the order of FIG. 11B through FIG. 11D, the door 3 is fastened to the housing 2. When the door 3 is closed, as shown in FIG. 11A, the hooking end of the latching arm 40 of the movable object side section 10M of the fastener 10 can go over the top of the hook part 54 of the hooked member 50 of the fixed object side section 10S and move up to the position of FIG. 11B where it can hook onto the hook part 54.

By pushing down the handle 32K of the toggle lever 30 from the position of FIG. 11B to pivotally move the toggle lever 30 around the pivot pin 36 in a clockwise direction of FIG. 11, and the toggle lever 30 is folded so as to stack on the fixed pedestal 20 as shown in FIG. 11D. Thus, as shown in FIG. 11D, the latching arm 40 and the toggle lever 30 become almost a straight line, and this latching arm 40 and the toggle lever 30 have a toggle function between the hooked member 50 and the fixed pedestal 20 to fasten the door 3 and housing body 2 to each other.

When the toggle lever 30 is folded onto the fixed pedestal 20, the pair of hook parts 62SK of the latch member 62 of the locking means 60 follows the curved surface 62SKC below and gets hooked to the pair of hook parts 64E of the locking piece 64 that is integral with the fixed pedestal 20, and the toggle lever 30 is locked to the fixed pedestal 20.

Meanwhile, as shown in FIG. 10, FIG. 11A through FIG. 11C, as for the pressing member 72 of the looseness prevention means 70, until the hook pin 48 is hooked to the hook part 54 of the hooked member 50, the elastic engaging piece 72R is in a raised position by being biased by the spring 76 in an anticlockwise direction in FIG. 11 around the pivot pin 74 till it abuts against the top plate 42 of the latching arm 40. However, as shown in FIG. 11D, when the hook pin 48 of the latching arm 40 is hooked to the hook part 54 of the hooked member 50 and fastened until the toggle lever 30 and the latching arm 40 reach a fastened position, the latching arm 40 is pulled to the right direction in FIG. 11, and therefore, the pressing member 72 pivots relatively in the clockwise direction of FIG. 11 around the pivot pin 74 in a direction opposite to the hook part 54 of the hook pin 48 while resisting the spring-bias, and the elastic engaging piece 72R of the pressing member 72 presses the door 3 against the receiving edge 2E of the housing body 2 to prevent a loosening of the door 3 and fixes the door 3 in a stable state with respect to the housing body 2 as shown in FIG. 11D.

When opening the door 3, at the position of the FIG. 11D, the lock release piece 62TR of the locking means 60 is pushed in the direction of the latching arm 40 side. When the lock release piece 62TR is pushed, the latch member 62 retracts towards the latching arm 40 while compressing the spring 66, and the hook part 62SK comes off of the pair of hook part 64E of the locking piece 64, and therefore, the toggle lever 30 is released from the fixed pedestal 20. Consequently, by operating the handle 32K of the toggle lever 30 to displace the toggle lever 30 and the latching arm 40 in the order of FIG. 11C, FIG. 11B and FIG. 11A, the hook pin 48 can be released from the hooked member 50. In this way, it is possible to release the toggle type fastener and to open the door 3 from the housing body 2.

In the toggle type fastener 10 of the present invention, the looseness prevention means 70 is provided in the latching arm 40 instead of in the hooked member 50 unlike the prior art. Thus, as shown in FIG. 10, when the door 3 is opened with the fastener 10 in a released state, the looseness prevention means 70 does not project into the opening 2K of the housing body 2, and the hooked member 50 can also be of a low and simple design such that the hook pin 48 of the latching arm 40 hooks to the hooked member 50. Accordingly, loading/unloading of items through the opening 2K of the housing body 2 can be performed easily without any obstruction, and the items will not be damaged.

According to the present invention, as described above, the looseness prevention means is provided in the latching arm rather than in the hooked member unlike the prior art. Therefore, when the movable object is opened with the fastener in a released state, the looseness prevention means does not project into the opening of the fixed object. Further, the hooked member can also be of a small and simple design, and accordingly, loading/unloading of items through the opening of the fixed object can be performed easily without any obstruction, and there is also no chance of items getting damaged. Consequently, the industrial applicability improves.

While the principles of the disclosure have been described above in connection with specific apparatuses and methods, it is to be clearly understood that this description is made only by way of example and not as limitation on the scope of the invention.

What is claimed is:

1. A toggle fastener to releaseably couple a fixed object and a movable object to each other, the toggle fastener comprising:

a pedestal that is structured to be fixed to the movable object;

a toggle lever pivotally coupled to the pedestal;

a latching arm pivotally coupled to the toggle lever; and a looseness prevention element that prevents movement of the movable object, the looseness prevention element attached to the latching arm and having a hook pin which is sized to be hooked to a hooked member that is structured to be fixed to the fixed object;

wherein the looseness prevention element includes a pressing member that contacts the movable object when the movable object and the fixed object are releaseably coupled;

wherein the looseness prevention element further includes a hooking element that is sized to be hooked to the hooked member.

2. The toggle type fastener according to claim 1, wherein the pressing member contacts the movable object when the hooking part is coupled to the hooked member and the movable object and the fixed object are releaseably coupled.

3. The toggle fastener according to claim 1, wherein the looseness prevention element is pivotally supported by the latching arm.

4. The toggle fastener according to claim 1, wherein the pressing member is biased towards a top plate of the latching arm by a spring.

5. The toggle fastener according to claim 4, wherein the pressing member contacts the movable object while resisting the spring bias when the hooking part is coupled to the hooked member and the movable object and the fixed object are releaseably coupled.

6. A toggle fastener to releaseably couple a fixed object and a movable object to each other, the toggle fastener comprising:

a pedestal that is structured to be fixed to the movable object;

a toggle lever pivotally coupled to the pedestal;

a latching arm pivotally coupled to the toggle lever; and a looseness prevention element that prevents movement of the movable object, the looseness prevention element attached to the latching arm and having a hook pin which is sized to be hooked to a hooked member that is structured to be fixed to the fixed object;

wherein the looseness prevention element is pivotally supported by the latching arm.

7. The toggle fastener according to claim 6, wherein the looseness prevention element includes a pressing member that contacts the movable object when the movable object and the fixed object are releaseably coupled.

8. The toggle fastener according to claim 7, wherein the looseness prevention element further includes a hooking element that is sized to be hooked to the hooked member.

9. The toggle fastener according to claim 8, wherein the pressing member contacts the movable object when the hooking part is coupled to the hooked member and the movable object and the fixed object are releaseably coupled.

10. The toggle fastener according to claim 7, wherein the pressing member is biased towards a top plate of the latching arm by a spring.

11. The toggle fastener according to claim 10, wherein the pressing member contacts the movable object while resisting the spring bias when the hooking part is coupled to the hooked member and the movable object and the fixed object are releaseably coupled.

12. A toggle fastener to releaseably couple a fixed object and a movable object to each other, the toggle fastener comprising:

a pedestal that is structured to be fixed to the movable object;

a toggle lever pivotally coupled to the pedestal;

a latching arm pivotally coupled to the toggle lever; and a looseness prevention element that prevents movement of the movable object, the looseness prevention element attached to the latching arm and having a hook pin which is sized to be hooked to a hooked member that is structured to be fixed to the fixed object;

wherein the looseness prevention element includes a pressing member that contacts the movable object when the movable object and the fixed object are releaseably coupled;

wherein the pressing member is biased towards a top plate of the latching arm by a spring.

13. The toggle type fastener according to claim 12, wherein the pressing member contacts the movable object while resisting the spring bias when the hooking part is coupled to the hooked member and the movable object and the fixed object are releaseably coupled.

14. The toggle fastener according to claim 12, wherein the looseness prevention element further includes a hooking element that is sized to be hooked to the hooked member.

15. The toggle fastener according to claim 14, wherein the pressing member contacts the movable object when the hooking part is coupled to the hooked member and the movable object and the fixed object are releaseably coupled.

16. The toggle fastener according to claim 12, wherein the looseness prevention element is pivotally supported by the latching arm.

* * * * *